US008064802B2

(12) United States Patent
Ebara et al.

(10) Patent No.: US 8,064,802 B2
(45) Date of Patent: Nov. 22, 2011

(54) DRIVING-FORCE TRANSMISSION DEVICE AND IMAGE FORMING APPARATUS

(75) Inventors: Joh Ebara, Kanagawa (JP); Kazuhiko Kobayashi, Tokyo (JP); Yohei Miura, Tokyo (JP); Takuya Uehara, Tokyo (JP); Takuya Murata, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 451 days.

(21) Appl. No.: 12/318,360

(22) Filed: Dec. 29, 2008

(65) Prior Publication Data

US 2009/0169259 A1 Jul. 2, 2009

(30) Foreign Application Priority Data

Dec. 28, 2007 (JP) ..... 2007-339140
Sep. 4, 2008 (JP) ..... 2008-226844

(51) Int. Cl.
*G03G 15/00* (2006.01)

(52) U.S. Cl. ..... 399/167

(58) Field of Classification Search ..... 399/167
See application file for complete search history.

(56) References Cited

U.S. PATENT DOCUMENTS

| | | | | |
|---|---|---|---|---|
| 6,175,706 | B1 * | 1/2001 | Watanabe et al. | 399/167 |
| 6,308,039 | B1 * | 10/2001 | Haneda et al. | 399/328 |
| 6,382,837 | B1 * | 5/2002 | Olbrich et al. | 384/278 |
| 6,397,029 | B1 * | 5/2002 | Portig | 399/167 |
| 7,184,690 | B2 * | 2/2007 | Ueno et al. | 399/117 |
| 7,415,224 | B2 * | 8/2008 | Hayakawa | 399/111 |
| 2003/0068177 | A1 * | 4/2003 | Kitayama | 399/167 |
| 2005/0191092 | A1 * | 9/2005 | Toso et al. | 399/167 |
| 2008/0152388 | A1 * | 6/2008 | Ueno et al. | 399/167 |
| 2009/0074474 | A1 * | 3/2009 | Oomori et al. | 399/279 |

FOREIGN PATENT DOCUMENTS

| | | |
|---|---|---|
| JP | 2001-235970 | 8/2001 |
| JP | 2002-295610 | 10/2002 |
| JP | 2002-328499 | 11/2002 |
| JP | 2005-345906 | 12/2005 |
| JP | 2006-084771 | 3/2006 |
| JP | 2006-145774 | 6/2006 |
| JP | 3839932 | 8/2006 |
| JP | 2006-246629 | 9/2006 |
| JP | 2006-317474 | 11/2006 |
| JP | 2007-003823 | 1/2007 |

OTHER PUBLICATIONS

English language abstract of Japanese Publication No. JP 10-240103, published Sep. 11, 1998.

* cited by examiner

*Primary Examiner* — David Gray
*Assistant Examiner* — David Bolduc
(74) *Attorney, Agent, or Firm* — Harness, Dickey & Pierce, P.L.C.

(57) ABSTRACT

A driving-force transmitting member is formed of a material having a linear expansion coefficient larger than that of a sleeve bearing, and $\Delta x1 > r1 \times \Delta t \times a - R1 \times \Delta t \times b$ is satisfied, where R1 is inner radius of the sleeve bearing, r1 is outer radius of a rotary shaft unit, $\Delta x1$ is difference between the inner radius R1 and the outer radius r1 at a reference temperature, $\Delta t$ is maximum amount of temperature change of the driving-force transmitting member relative to the reference temperature, a is linear expansion coefficient of the sleeve bearing, and b is linear expansion coefficient of the driving-force transmitting member.

14 Claims, 14 Drawing Sheets

DRIVING-FORCE TRANSMISSION DEVICE AND IMAGE FORMING APPARATUS

CROSS-REFERENCE TO RELATED APPLICATIONS

The present application claims priority to and incorporates by reference the entire contents of Japanese priority document 2007-339140 filed in Japan on Dec. 28, 2007 and Japanese priority document 2008-226844 filed in Japan on Sep. 4, 2008.

BACKGROUND OF THE INVENTION

1. Field of the Invention

The present invention relates to a driving-force transmission device and an image forming apparatus that employs the driving-force transmission device.

2. Description of the Related Art

A driving-force transmission device that is employed in an image forming apparatus transmits a rotary driving force from a driving source such as a motor to a rotating unit (drive target) such as an image carrier. When the rotating unit is detachable from the image forming apparatus, the driving-force transmission device typically includes a gear (driving-force input unit) that receives the rotary driving force from the driving source, a rotary shaft mounted on the gear, and a coupling member that is mounted on the rotary shaft and couples to a coupled portion of the rotating unit. A driving-force transmission device having such a configuration is disclosed in, for example, Japanese Patent Application Laid-open No. 2002-328499. With such a configuration, fluctuation in rotational velocity of the rotating unit largely depends upon adverse effect by a gear and a coupling member. The adverse effect by the gear includes eccentricity of the gear and eccentric error in mounting the gear on a rotary shaft, and the adverse effect by the coupling member includes eccentricity of the coupling member, eccentric error in mounting the coupling member on rotary shaft, and an engaging gap between the coupling member and a coupled portion.

The adverse effect by the eccentricity of the gear and the coupling member can be suppressed by improving molding accuracy.

Furthermore, the adverse effect by the gap between the coupling member and the coupled portion can be suppressed by applying spline engagement in which the coupling member and the coupled portion can be molded with low shape error and can be easily detached. In the spline engagement, one of the rotary shaft of the rotating unit and a boss portion of a driving-force transmitting member is formed into a spline shaft, and a spline hole is formed in the other. The spline shaft is inserted into the spline hole to mesh external teeth on the spline shaft with internal teeth in the spline hole.

Moreover, the adverse effect by the eccentric error in mounting the gear or the coupling member on the rotary shaft can be suppressed by mounting the gear and the coupling member on the rotary shaft without causing backlash.

Recently, resin has been increasingly used for forming a gear and a coupling member on the beneficial aspects of vibration, noise, and cost. On the other hand, metal is often used for a rotary shaft on the beneficial aspect of torsional stiffness. However, with a combination use of parts molded from different materials, linear coefficient of expansion differs between the parts. Therefore, a gap may be formed at engaging portion between the rotary shaft and the gear or between the rotary shaft and the coupling member due to temperature change in an operating environment and heat generated from a driving source in an image forming apparatus. This leads to backlash of the gear or the coupling member relative to the rotary shaft and eccentric rotation of the gear or the coupling member, resulting in fluctuation in rotational velocity of the rotating unit.

To address such fluctuation, the inventors of the present invention have invented a driving-force transmission device that employs a driving-force transmitting member including a rotary shaft unit, a gear, and a coupling member, all of which are integrally formed using the same material of resin. The use of such a driving-force transmission device does not cause the backlash even if the driving-force transmitting member thermally expands. Therefore, the eccentric rotation of the gear and the coupling member can be sufficiently suppressed.

However, the inventors found that the above driving-force transmitting member causes the following problem.

The driving-force transmitting member needs to be supported in a rotatable manner in an image forming apparatus to allow transmission of a rotary driving force that is input to the gear, from the coupling member to a drive target. Therefore, the driving-force transmitting member needs to be supported at least at two support portions by a support member such as a side plate on a side of an image forming apparatus via a metal sleeve bearing. With the use of such a sleeve bearing, sliding friction between an outer circumferential surface of the rotary shaft unit of the driving-force transmitting member and an inner circumferential surface of the sleeve bearing can be suppressed low over a prolonged period. In this manner, generally, the driving-force transmitting member can be rotatably supported by the support member for a long period. However, resin that forms the driving-force transmitting member has the linear coefficient of expansion larger than metal that forms the sleeve bearing. Accordingly, if the driving-force transmitting member thermally expands by temperature rise in an operating environment or heat from a heat source such as a motor, a gap between the outer circumferential surface of the rotary shaft unit and the inner circumferential surface of the sleeve bearing is reduced, so that friction loading between the outer circumferential surface of the rotary shaft unit and the inner circumferential surface of the sleeve bearing increases, i.e., rotation load on the driving-force transmitting member increases, leading to overload on the motor to be stopped.

The countermeasure for the above is to reduce a diameter of the rotary shaft unit at the support portion to as small as possible to suppress a dimensional change in the rotary shaft unit when the driving-force transmitting member thermally expands. However, in the driving-force transmitting member employing an engagement in which one end of the rotary shaft unit engages with an engaging target arranged concentrically with the rotary shaft unit (for example, spline engagement) as a configuration of the gear and the coupling member, a diameter of the one end of the rotary shaft unit needs to be increased to assure the strength of the one end. Therefore, when the driving-force transmitting member thermally expands, the dimensional change of the rotary shaft unit is increased at the support portion in the one end (large-diameter portion), resulting in overload on the motor to be stopped.

Still worse, at the support portion on the side of the large-diameter portion, frictional heat between the outer circumferential surface of the rotary shaft unit and the inner circumferential surface of the sleeve bearing causes the rotary shaft unit to be melted and adhered to the sleeve shaft. Under such a circumstance, if rotation of the sleeve bearing is restricted relative to the support member (including the case where the sleeve bearing cannot rotate relative to the support member due to increased frictional force caused by the thermally-expanded sleeve bearing), the driving-force transmitting member can not be rotated, causing overload on the motor to be stopped.

Such a problem occurs not only in the case where the driving-force transmitting member is formed of resin and the sleeve bearing is formed of metal, but also in the case where the driving-force transmitting member is formed from a material having linear coefficient of expansion larger than that for the sleeve bearing.

Furthermore, this can occur also between the sleeve bearing and the support member. If the sleeve bearing is formed from a material having linear coefficient of expansion larger than that for the support member, frictional force between the sleeve bearing and the support member increases by the thermally-expanded sleeve bearing, so that a motor may stop due to overloading. Moreover, if the rotation of-the sleeve bearing is restricted relative to the driving-force transmitting member (including the case where the driving-force transmitting member cannot rotate relative to the sleeve bearing due to the thermal expansion of the driving-force transmitting member), the diving-force-transmitting unit can not be rotated and the motor may stop due to overloading.

SUMMARY OF THE INVENTION

It is an object of the present invention to at least partially solve the problems in the conventional technology.

According to one aspect of the present invention, there is provided a driving-force transmission device including a driving-force transmitting member that includes a rotary shaft unit including a large-diameter portion at a first end and a small-diameter portion at a second end, a driving-force input unit that is engaged with a driving unit that is connected to a driving source to receive a rotary driving force, and a driving-force output unit that is engaged with a drive target to output the rotary driving force to the drive target, which are integrally formed, one of the driving-force input unit and the driving-force output unit being formed at the first end and is engaged with an engaging target arranged concentrically on the rotary shaft unit, other one of the driving-force input unit and the driving-force output unit being formed on an outer circumference of the rotary shaft unit; a support member that rotatably supports the rotary shaft unit at a first support portion of the large-diameter portion and at a second support portion of the small-diameter portion; and a sleeve bearing that is arranged between the first support portion and the support member such that rotation of the driving-force transmitting member in a rotational direction relative to the support member is restricted. The driving-force transmitting member is formed of a material having a linear expansion coefficient larger than that of the sleeve bearing, and $\Delta x1 > r1 \times \Delta t \times a - R1 \times \Delta t \times b$ is satisfied, where R1 is inner radius of the sleeve bearing, r1 is outer radius of the rotary shaft unit, $\Delta x1$ is difference between the inner radius R1 and the outer radius r1 at a reference temperature, $\Delta t$ is maximum amount of temperature change of the driving-force transmitting member relative to the reference temperature, a is linear expansion coefficient of the sleeve bearing, and b is linear expansion coefficient of the driving-force transmitting member.

Furthermore, according to another aspect of the present invention, there is provided a driving-force transmission device including a driving-force transmitting member that includes a rotary shaft unit including a large-diameter portion at a first end and a small-diameter portion at a second end, a driving-force input unit that is engaged with a driving unit that is connected to a driving source to receive a rotary driving force, and a driving-force output unit that is engaged with a drive target to output the rotary driving force to the drive target, which are integrally formed, one of the driving-force input unit and the driving-force output unit being formed at the first end and is engaged with an engaging target arranged concentrically on the rotary shaft unit, other one of the driving-force input unit and the driving-force output unit being formed on an outer circumference of the rotary shaft unit; and a support member that rotatably supports the rotary shaft unit at a first support portion of the large-diameter portion and at a second support portion of the small-diameter portion. The driving-force transmitting member is formed of a material having a linear expansion coefficient larger than that of the support member that rotatably supports the rotary shaft unit at the first support portion, and $\Delta x2 > r2 \times \Delta t \times e - R2 \times \Delta t \times b$ is satisfied, where R2 is inner radius of a portion of the support member on which the rotary shaft unit of the driving-force transmitting member is attached, r2 is outer radius of the rotary shaft unit, $\Delta x2$ is difference between the inner radius R2 and the outer radius r2 at a reference temperature, $\Delta t$ is maximum amount of temperature change of the driving-force transmitting member relative to the reference temperature, e is linear expansion coefficient of the support member that rotatably supports the rotary shaft unit at the first support portion, and b is linear expansion coefficient of the driving-force transmitting member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
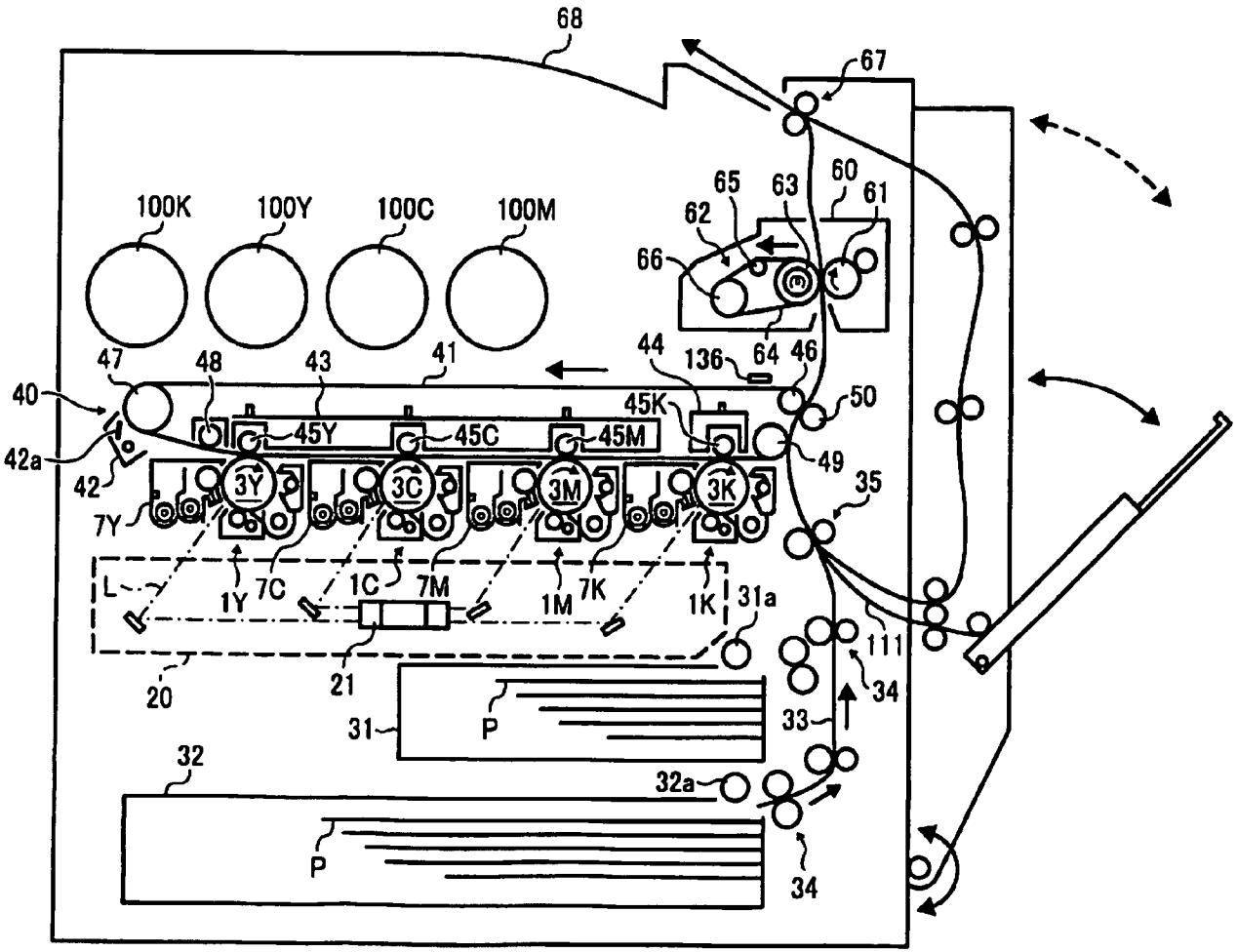
FIG. 1 is a schematic diagram of an image forming apparatus according a first embodiment of the present invention.
Figure 2:
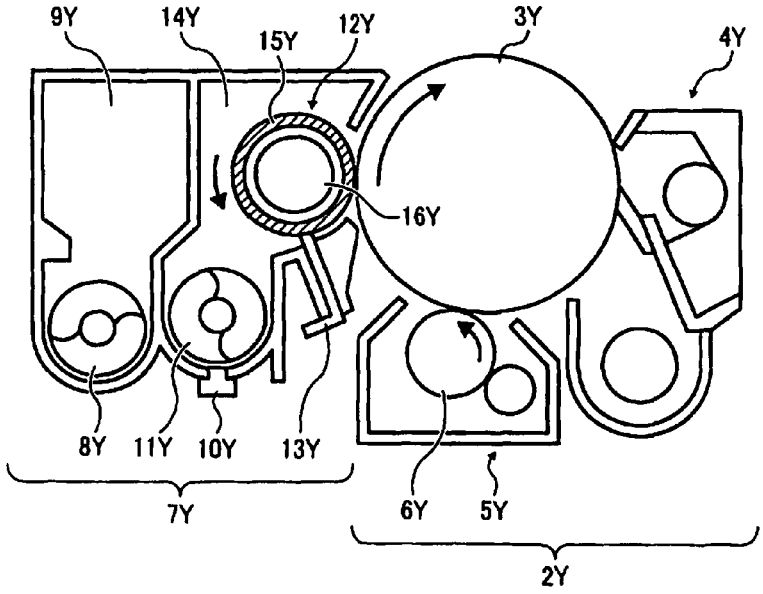
FIG. 2 is an enlarged view of a process unit for yellow in the image forming apparatus.
Figure 3:
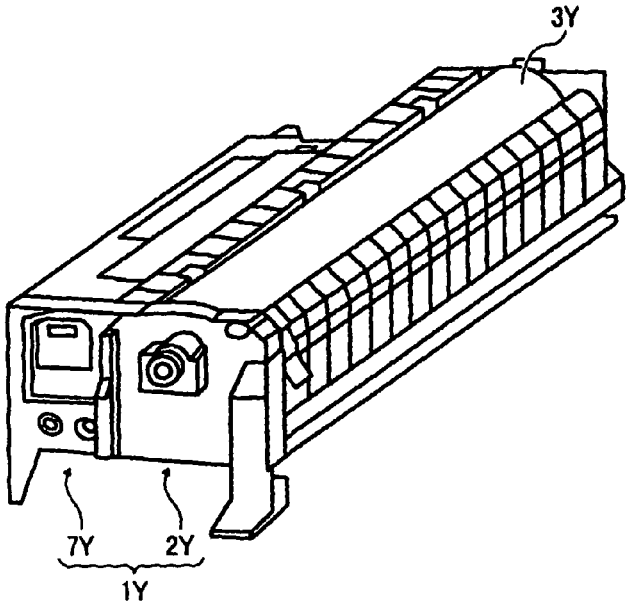
FIG. 3 is a perspective view of the process unit.
Figure 4:
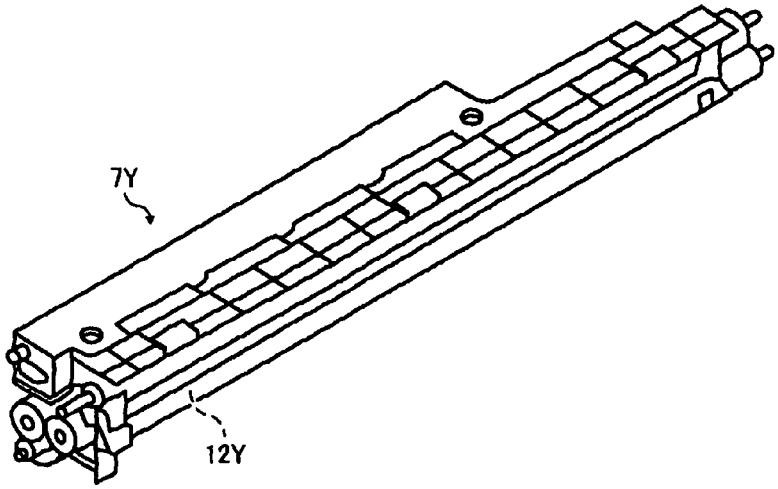
FIG. 4 is a perspective view of a developing unit of the process unit.

In the following embodiments, the present invention is applied to a printer employing an electrophotographic system as an image forming apparatus (hereinafter, "image forming apparatus"). FIG. 1 is a schematic diagram of the image forming apparatus according a first embodiment of the present invention. The image forming apparatus includes process units 1Y, 1C, 1M, and 1K for forming four different-color toner images of black (B), yellow (Y), cyan (C), and magenta (M), all of which have the same construction except difference in color of toner as an image forming substance. Therefore, only the process unit 1Y is explained below. FIG. 2 is a schematic diagram of the process unit 1Y. The process unit 1Y includes a photosensitive-element unit 2Y and a developing unit 7Y as shown in FIG. 2. The photosensitive-element unit 2Y and the developing unit 7Y are collectively detachable as the process unit 1Y as shown in FIG. 3 from the body of the image forming apparatus. In a state that the process unit 1Y is detached from the image forming apparatus, the developing unit 7Y as shown in FIG. 4 is also detachable from the photosensitive-element unit 2Y. Alternatively, the photosensitive-element unit 2Y and the developing unit 7Y can be configured integrally.

In a process unit 1, holes are formed in flanges at both ends of the photosensitive-element unit 2Y as a main reference portion for positioning when being mounted on the body of the image forming apparatus. Furthermore, a sub-reference portion (not shown) for positioning is provided on a near side and a far side of a casing in a direction in which the process unit 1 is detached from the image forming apparatus. Accordingly, when the photosensitive-element unit 2Y and the developing unit 7Y are collectively mounted on the body of the image forming apparatus, the reference portions engage with engaged portions of the image forming apparatus, enabling to surely position the photosensitive-element unit 2Y to an intended position in the image forming apparatus.

As shown in FIG. 2, the photosensitive-element unit 2Y includes a drum-type photosensitive element 3Y, a drum cleaning unit 4Y, a neutralizing unit (not shown), a charging unit 5Y, and a charging roller 6Y.

The charging unit 5Y uniformly charges the surface of the photosensitive element 3Y that is driven to rotate clockwise in FIG. 2 by a driving unit (not shown). Specifically, the charging unit 5Y uniformly charges the photosensitive element 3Y by driving the charging roller 6Y to rotate counterclockwise in FIG. 2 while being applied with a charging bias by a power source (not shown) and bringing the charging roller 6Y closer to the photosensitive element 3Y. Alternatively, a charging brush can be brought into contact with the photosensitive element 3Y for uniformly charging of the photosensitive element 3Y. Still alternatively, a scorotron charger employing a charger system can be used for uniformly charging of the photosensitive element 3Y. The uniformly charged surface of the photosensitive element 3Y is then scanned with laser light emitted from an optical writing unit 20 shown in FIG. 1, so that an electrostatic latent image for yellow is formed on the photosensitive element 3Y.

The developing unit 7Y includes a first developer container 9Y in which a first conveying screw 8Y is arranged and a second developer container 14Y in which a toner-density sensor 10Y constructed of a magnetic permeability sensor, a second conveying screw 11Y, a developing roller 12Y, a doctor blade 13Y, and so on are arranged. A Y-developer (not shown) including a magnetic carrier and a negatively-charged Y-toner is contained in the first developer container 9Y and the second developer container 14Y. The first conveying screw 8Y is driven to rotate by a driving unit (not shown), so that the Y-developer in the first developer container 9Y is conveyed from a near side to a far side in a direction perpendicular to the plane of FIG. 2. Then, the Y-developer enters into the second developer container 14Y through a communicating opening (not shown) formed in a partition between the first developer container 9Y and the second developer container 14Y.

The second conveying screw 11Y in the second developer container 14Y is driven to rotate by a driving unit (not shown) and conveys the Y-developer from the far side to the near side. The toner-density sensor 10Y fixed to a lower portion of the first developer container 9Y detects density of the Y-developer that is being conveyed. The developing roller 12Y is arranged above the second conveying screw 11Y to be in parallel with each other. The developing roller 12Y is configured such that a magnetic roller 16Y is covered with a developing sleeve 15Y made of a nonmagnetic pipe that is driven to rotate counterclockwise in FIG. 2. Some of the Y-developer conveyed by the second conveying screw 11Y is attracted to the surface of the developing sleeve 15Y by magnetic force exerted by the magnetic roller 16Y. The thickness of the Y-developer on the developing sleeve 15Y is regulated by the doctor blade 13Y that is arranged with a predetermined gap from the developing sleeve 15Y as a developer carrier. The thickness-regulated Y-developer is subsequently conveyed to a developing area opposed to the photosensitive element 3Y, in which the Y-toner of the Y-developer is adhered to a Y-latent image formed on the photosensitive element 3Y, thereby forming a Y-toner image on the photosensitive element 3Y. The Y-developer of which the Y-toner is consumed in the developing process returns onto the second conveying screw 11Y with the rotation of the developing sleeve 15Y. The Y-developer is subsequently conveyed to the end of the near side to return to the first developer container 9Y through the communicating opening.

A result of the detection of the permeability of the Y-developer by the toner-density sensor 10Y is sent to a control unit (not shown) as a voltage signal. Because the permeability of the Y-developer correlates with the density of the Y-toner of the Y-developer, the toner-density sensor 10Y outputs the voltage signal corresponding to the density of the Y-toner. The control unit includes a random access memory (RAM) to store a target value Vtref for a voltage output from the toner-density sensor 10Y, and also data of each target value Vtref for a voltage output from each of toner-density sensors 10C, 10M, and 10K mounted on the process units 1C, 1M, and 1K. The developing unit 7Y compares the voltage output from the toner-density sensor 10Y with the Vtref for the Y-toner and operates a Y-toner-supply unit (not shown) for time period according to the result of the comparison, thereby supplying an appropriate amount of the Y toner to the Y-developer that has lower toner density by consumption of the Y-toner in the developing process, in the first developer container 9Y. With the toner supply operation, the density of the Y-toner of the Y-developer in the second developer container 14Y is maintained within an appropriate range. The process units 1C, 1M, and 1K perform toner supply to developers in the same manner.

The Y-toner image formed on the photosensitive element 3Y as a latent-image carrier is intermediately transferred onto an intermediate transfer belt 41 as an intermediate transfer unit shown in FIG. 1. The drum cleaning unit 4Y removes residual toner on the surface of the photosensitive element 3Y after the intermediate transfer process. Then, the surface of the photosensitive element 3Y is neutralized by the neutralizing unit, whereby the surface is initialized to be ready for the next image forming process. In the same manner, in the process units 1C, 1M, and 1K, each of a C-toner image, an M-toner image, and a K-toner image is formed on corresponding one of photosensitive elements 3C, 3M, and 3K and is intermediately transferred onto the intermediate transfer belt 41.

The optical writing unit 20 serving as a latent-image forming unit is arranged under the process units 1Y, 1C, 1M, and 1K in FIG. 1. The optical writing unit 20 emits laser light L from a light source based on an image data to irradiate the photosensitive elements 3Y, 3C, 3M, and 3K, thereby forming latent images for Y, C, M, and K on the photosensitive elements 3Y, 3C, 3M, and 3K. The optical writing unit 20 irradiates the photosensitive elements 3Y, 3C, 3M, and 3K with the laser light L through a plurality of optical lenses and mirrors while deflecting the laser light L with a polygon mirror 21 shown in FIG. 1 that is driven to rotate by a motor. Alternatively, an optical scanning system employing an LED (light emitting diode) array is adoptable.

A first feed tray 31 and a second feed tray 32, each of which accommodates recording sheets P in a stacked state, are arranged vertically under the optical writing unit 20, and an uppermost recording sheet P in each of the first feed tray 31 and the second feed tray 32 is in contact with corresponding one of a first feeding roller 31*a* and a second feeding roller 32*a*. When the first feeding roller 31*a* is driven to rotate counterclockwise in FIG. 1 by a driving unit (not shown), the uppermost recording sheet P in the first feed tray 31 is fed toward a conveying path 33. Similarly, when the second feeding roller 32*a* is driven to rotate counterclockwise in FIG. 1 by a driving unit (not shown), the uppermost recording sheet P in the second feed tray 32 is fed toward the conveying path 33. The recording sheet P is fed upward in FIG. 1 in the conveying path 33 while being caught between pairs of conveying rollers 34 arranged along the conveying path 33.

A pair of registration rollers 35 is arranged at an end portion of the conveying path 33. Immediately after nipping the recording sheet P conveyed by the conveying rollers 34, the registration rollers 35 stop the rotation. Then, the registration rollers 35 feed the recording sheet P toward a secondary-transfer nip portion to be described below at an appropriate timing.

A transfer unit 40 is arranged above the process units 1Y, 1C, 1M, and 1K to support and move the intermediate transfer belt 41 counterclockwise in FIG. 1. The transfer unit 40 includes a belt cleaning unit 42, a first bracket 43, a second bracket 44, primary-transfer rollers 45Y, 45C, 45M, and 45K, a secondary-transfer backup roller 46, a driving roller 47, an auxiliary roller 48, and a support roller 49, in addition to the intermediate transfer belt 41. The intermediate transfer belt 41 is driven to rotate endlessly counterclockwise in FIG. 1 by the driving roller 47 while being supported by the above rollers. Each of the primary-transfer rollers 45Y, 45C, 45M, and 45K nips the intermediate transfer belt 41 with corresponding one of the photosensitive elements 3Y, 3C, 3M, and 3K to form a primary-transfer nip portion, and applies a transfer bias with a polarity (for example, positive polarity) opposite to that of toner to a back side (inner surface in a loop) of the intermediate transfer belt 41. While the intermediate transfer belt 41 passing through the primary-transfer nip portions, the Y-toner image, the C-toner image, the M-toner image, and the K-toner image on the surfaces of the photosensitive elements 3Y, 3C, 3M, and 3K are sequentially primary-transferred onto the intermediate transfer belt 41 in a superimposed manner, whereby a four-color toner image is formed onto the intermediate transfer belt 41.

The secondary-transfer backup roller 46 nips the intermediate transfer belt 41 with a secondary-transfer roller 50 arranged outside of the intermediate transfer belt 41, so that the secondary transfer nip portion is formed. The registration rollers 35 feeds the recoding sheet P that is nipped the registration rollers 35, toward the secondary transfer nip portion at a timing in synchronization with the four-color toner image on the intermediate transfer belt 41. The four-color toner image on the intermediate transfer belt 41 is collectively secondary-transferred onto the recoding sheet P in the secondary transfer nip portion by the action of the secondary-transfer electrical field formed between the secondary-transfer backup roller 46 and the secondary-transfer roller 50 to which a secondary-transfer bias is applied, and a pressure by the secondary transfer nip portion, so that a full-color image is formed in combination with a white color of the recoding sheet P.

Toner that has not been transferred onto the recording sheet P resides on the intermediate transfer belt 41 after passing through the secondary transfer nip portion. Such residual toner is cleaned by the belt cleaning unit 42. The belt cleaning unit 42 includes a cleaning blade 42*a*, which is brought into contact with the surface of the intermediate transfer belt 41 to scrap the residual toner on the surface of the intermediate transfer belt 41.

The first bracket 43 slides at an appropriate angle around a rotational axis of the auxiliary roller 48 with the on/off operation of a solenoid (not shown). When forming a black&white (B&W) image, the first bracket 43 is driven to rotate counterclockwise a little by the solenoid, thereby bringing the primary-transfer rollers 45Y, 45C, and 45M to revolve counterclockwise around the rotational axis of the auxiliary roller 48 to keep the intermediate transfer belt 41 away from the photosensitive elements 3Y, 3C, and 3M. In this state, only the process unit 1K is operated to form a B&W image. This can prevent unnecessary use of the process units 1Y, 1C, and 1M in the B&W image forming process, preventing the lifetime of the process units 1Y, 1C, and 1M from being shortened.

A fixing unit 60 is arranged above the secondary transfer nip portion in FIG. 1. The fixing unit 60 includes a heat-pressure roller 61 that contains a heat source such as a halogen lamp and a fixing belt unit 62. The fixing belt unit 62 includes an endless fixing belt 64, a heating roller 63 that contains a heat source such as a halogen lamp, a support roller 65, a driving roller 66, and a temperature sensor (not shown). The fixing belt 64 rotates endlessly counterclockwise in FIG. 1 while being supported by the heating roller 63, the support roller 65, and the driving roller 66, during which the inner side of the fixing belt 64 is heated with the heating roller 63. The heat-pressure roller 61 that rotates clockwise in FIG. 1 is in contact with outer surface of the fixing belt 64 at which the heating roller 63 supports the fixing belt 64, thereby forming a fixing nip portion at which the heat-pressure roller 61 and the fixing belt 64 are in contact with each other.

The temperature sensor is arranged outside of the loop of the fixing belt 64 to oppose the outer surface of the fixing belt 64 with a predetermined gap therefrom. The temperature sensor detects a temperature of the surface of the fixing belt 64 just before entering the fixing nip portion. The result of the detection is sent to a fixing power source circuit (not shown). Based on the result, the fixing power source circuit performs on/off control of power supplied to the heat sources in the heating roller 63 and the heat-pressure roller 61 to keep the surface temperature of the fixing belt 64 at about 140° C.

As shown in FIG. 1, the recording sheet P that has passed through the secondary-transfer nip portion is released from the intermediate transfer belt 41 to be fed into the fixing unit 60. The recording sheet P is heated and pressed while being conveyed in the fixing nip portion in the fixing unit 60, so that the full-color image is fixed to the recording sheet P.

Then, the recording sheet P, after passing through a pair of discharge rollers 67, is discharged to a stack unit 68 arranged to an upper portion of the image forming apparatus to be stacked on the stack unit 68.

Toner cartridges 100Y, 100C, 100M, and 100K that accommodate Y-toner, C-toner, M-toner, and K-toner are arranged above the transfer unit 40. Each of the Y-toner, the C-toner, the M-toner, and the K-toner in the toner cartridges 100Y, 100C, 100M, and 100K is appropriately supplied to each of the developing unit 7Y and developing units 7C, 7M, and 7K. Each of the toner cartridges 100Y, 100C, 100M, and 100K is detachable from the body of the image forming apparatus independently from the process units 1Y, 1C, 1M, and 1K.

Figure 5:
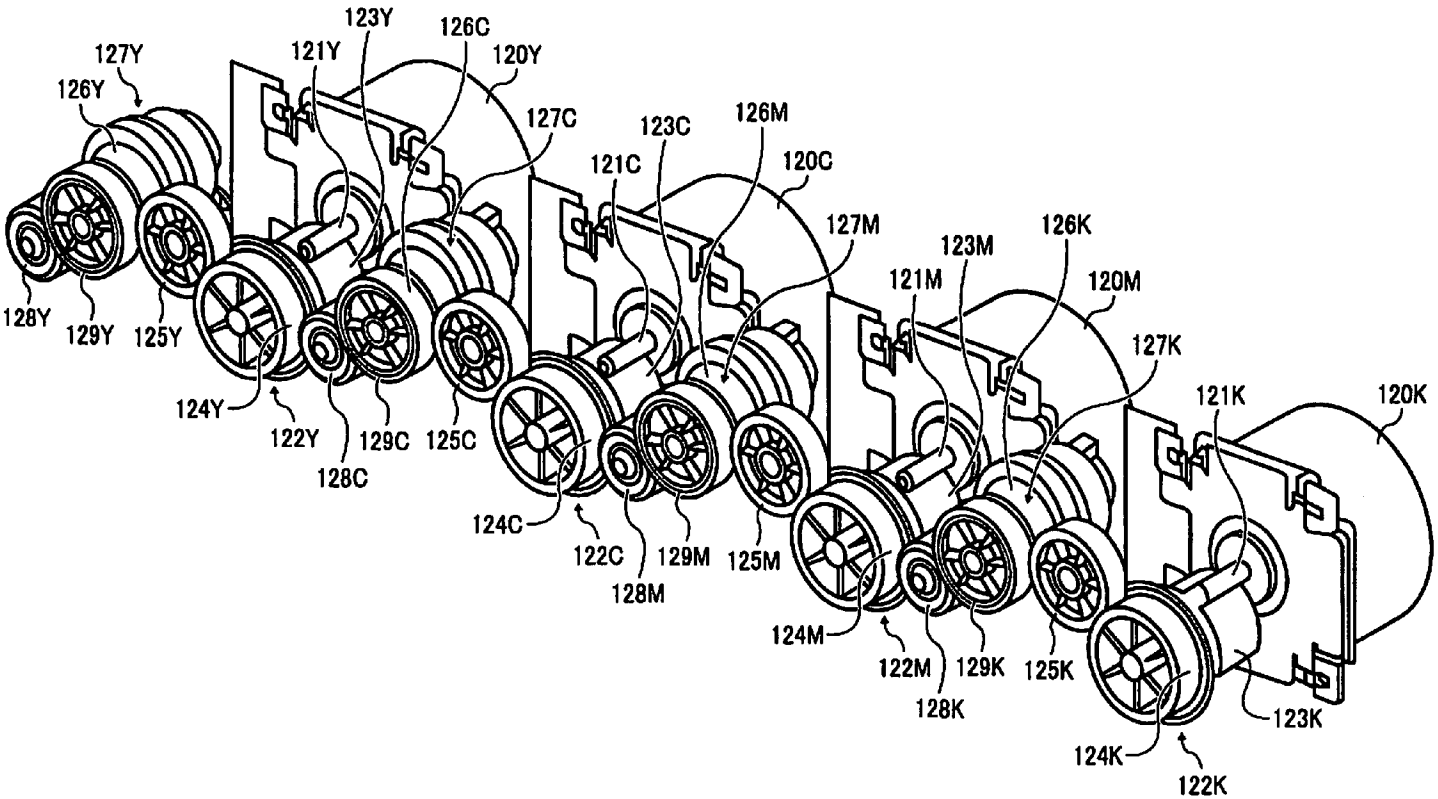
FIG. 5 is a perspective view of driving-force transmission devices arranged in a body side of the image forming apparatus.
Figure 6:
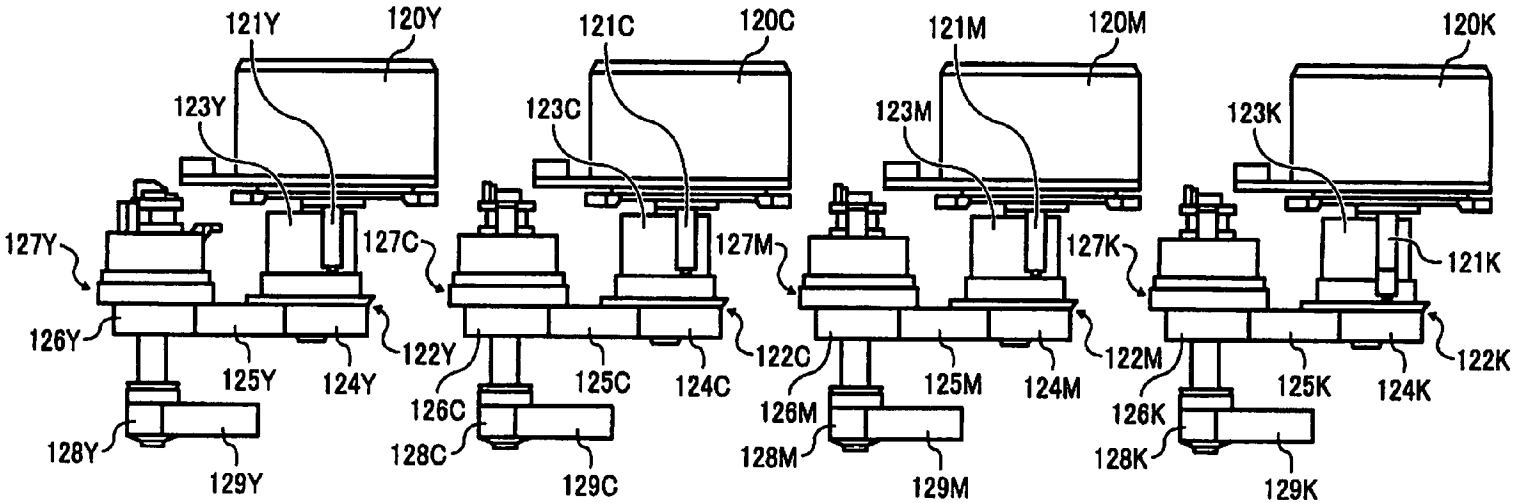
FIG. 6 is a plan view of the driving-force transmission devices viewed from above.

FIG. 5 is a perspective view of driving-force transmission devices for respective colors that are fixed to a housing of the image forming apparatus. FIG. 6 is a plan view of the driving-force transmission devices viewed from above. A first side plate 110*a* serving as a support member that constitutes a main body frame is arranged in the image forming apparatus, and process driving motors 120Y, 120C, 120M, and 120K that serves as a driving source are fixed to the first side plate 110*a*. The driving-force transmission devices have the same configuration, therefore; in the following, only the driving-force transmission device for yellow image is explained. A motor gear 121Y is coupled to a rotary shaft of the process driving motor 120Y to rotate concentrically therewith. For example, a direct current (DC) servomotor or a stepping motor as a DC brushless motor can be employed for the process driving motor 120Y.

A developing gear 122Y is arranged below the rotary shaft of the process driving motor 120Y. The developing gear 122Y engages with a shaft (not shown) that is fixed to and protrudes from the first side plate 110*a* to be slideably rotatable on the shaft. The developing gear 122Y includes a first gear 123Y and a second gear 124Y that is positioned nearer to the tip side of the rotary shaft of the process driving motor 120Y than the first gear 123Y. The first gear 123Y and the second gear 124Y are concentrically rotated. The developing gear 122Y slideably rotates on the fixed shaft by a rotary driving force from the process driving motor 120Y by bringing the first gear 123Y to engage with the motor gear 121Y.

A photosensitive-element gear 133Y (not shown) that serves as a driving-force transmitting member is arranged above the rotary shaft of the process driving motor 120Y. The reduction gear ratio between the motor gear 121Y and the photosensitive-element gear 133Y is, for example, 1:20. The one-speed reduction is used from the motor gear 121Y to the photosensitive-element gear 133Y, so that it is possible to reduce the number of parts to attain a low cost and factors for gear-engagement-attributable and eccentricity-attributable transmission errors by applying only two gears. With this one-speed reduction for such a large reduction gear ratio of 1:20, the photosensitive-element gear 133Y has a diameter larger than that of the photosensitive element 3Y. The photosensitive-element gear 133Y has such a large diameter, so that it is possible to reduce pitch error in an engaging portion with the photosensitive element 3Y to reduce fluctuation in printing density (banding) in a sub-scanning direction. The reduction gear ratio is determined based on speed region in which high efficiency and high rotation accuracy can be attained in a relation between a target speed of the photosensitive element 3Y and motor characteristics. The detailed construction of the photosensitive-element gear 133Y is explained later.

A first relay gear 125Y that engages with a fixed shaft (not shown) to be slideably rotates on the fixed shaft is arranged on a left side of the developing gear 122Y in FIG. 6. The first relay gear 125Y engages with the second gear 124Y on the upstream side in a transmission direction, so that the rotary driving force from the developing gear 122Y is transmitted to the first relay gear 125Y, whereby the first relay gear 125Y rotates slidingly on the fixed shaft. Moreover, the first relay gear 125Y engages with a clutch input gear 126Y on the downstream side in the transmission direction. The clutch input gear 126Y is supported by a developing clutch 127Y that transmits a rotary driving force of the clutch input gear 126Y to a clutch shaft and brings the clutch input gear 126Y to free-spin by on/off control of a power source by a control unit (not shown). On a tip side of the clutch shaft of the developing clutch 127Y, a clutch output gear 128Y is fixed. When power is supplied to the developing clutch 127Y, the rotary driving force of the clutch input gear 126Y is transmitted to the clutch shaft to rotate the clutch output gear 128Y. On the contrary, when the power supplied to the developing clutch 127Y is cut, even if the process driving motor 120Y is rotating, the clutch input gear 126Y free-spins on the clutch shaft, so that the clutch output gear 128Y stops its rotation.

A second relay gear 129Y that is slideably rotatable while engaging with a fixed shaft (not shown) is arranged on a right side of the clutch output gear 128Y in FIG. 6. The second relay gear 129Y rotates by engaging with the clutch output gear 128Y.

Figure 7:
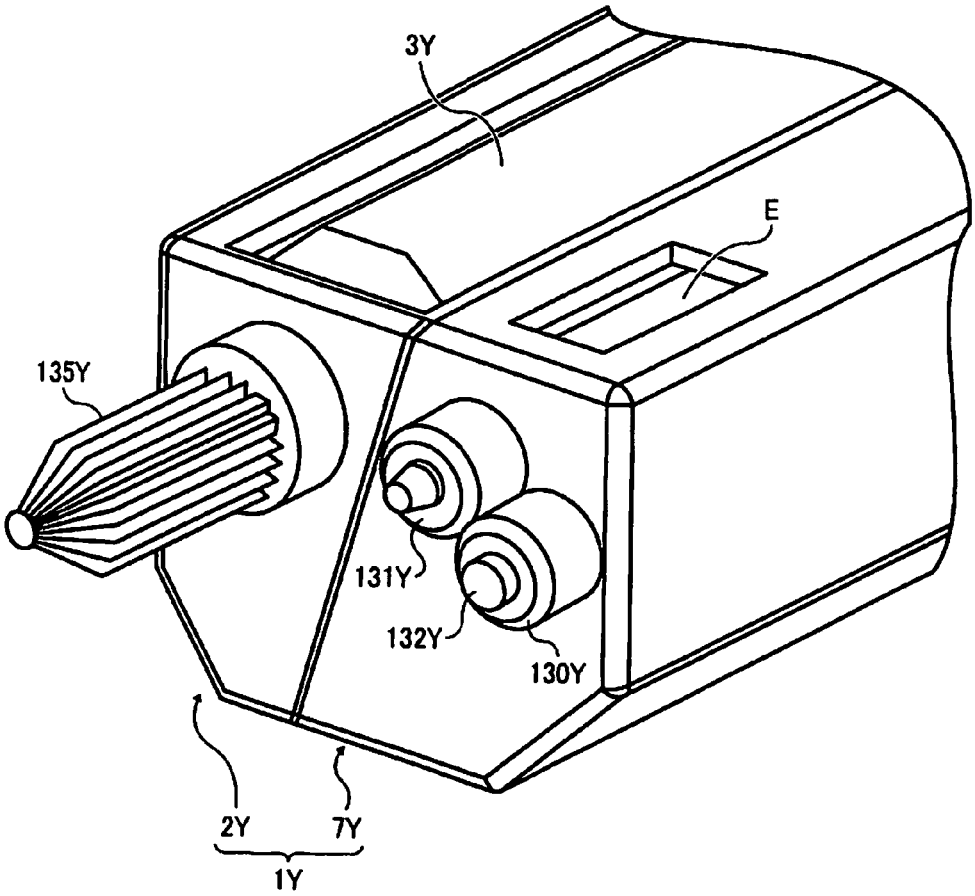
FIG. 7 is a perspective view partially explaining an end portion of the process unit.

FIG. 7 is a perspective view partially explaining an end portion of the process unit 1Y. A shaft of the developing sleeve 15Y housed in a casing of the developing unit 7Y passes through and protrudes from a side surface of the casing, and a sleeve upstream gear 131Y is fixed onto the protruding portion of the shaft. Furthermore, a fixed shaft 132Y is provided to protrude from the side surface of the casing, with which a third relay gear 130Y engages to be slidingly rotatable on the fixed shaft 132Y. The third relay gear 130Y engages with the sleeve upstream gear 131Y.

Moreover, one end of a rotary shaft (drive target member) of the photosensitive element 3Y passes through and protrudes from the side surface of the casing. The rotary shaft of the photosensitive element 3Y is rotatably supported relative to the casing of the process unit 1Y, so that the photosensitive element 3Y is positioned relative to the process unit 1Y. Part of the rotary shaft of the photosensitive element 3Y that protrudes from the side surface of the casing is splined to form a spline shaft 135Y that is inserted into a spline hole formed in the photosensitive-element gear 133Y.

In a state that the process unit 1Y is set and positioned to the image forming apparatus, the third relay gear 130Y engages with the sleeve upstream gear 131Y and the second relay gear 129Y, so that a rotary driving force of the second relay gear 129Y is sequentially transmitted to the third relay gear 130Y and the sleeve upstream gear 131Y to-rotate the developing sleeve 15Y. Furthermore, the spline shaft 135Y engages with the spline hole formed in the photosensitive-element gear 133Y.

Although the process unit 1Y is exemplified herein, a rotary driving force is transmitted to a developing sleeve in the same way in the process units 1C, 1M, and 1K.

Although only one end portion of the process unit 1Y is explained in FIG. 7, the other end of the shaft of the developing sleeve 15Y also protrudes from the other side surface of the casing and a sleeve downstream gear (not shown) is fixed on the protruding portion of the shaft. In addition, shafts of the first conveying screw 8Y and the second conveying screw 11Y also protrude from the other side surface of the casing, and a first screw gear and a second screw gear (both are not shown) are respectively fixed on the protruding portions of the shafts. With the rotation of the developing sleeve 15Y by the rotary driving force transmitted from the sleeve upstream gear 131Y, the sleeve downstream gear rotates. The sleeve downstream gear engages with the second screw gear to transmit the rotary driving force thereto, whereby the second conveying screw 11Y rotates. Moreover, the second screw gear engages with the first screw gear to transmit the rotary driving force thereto, whereby the first conveying screw 8Y rotates. The process units 1C, 1M, and 1K have the same construction.

Figure 8:
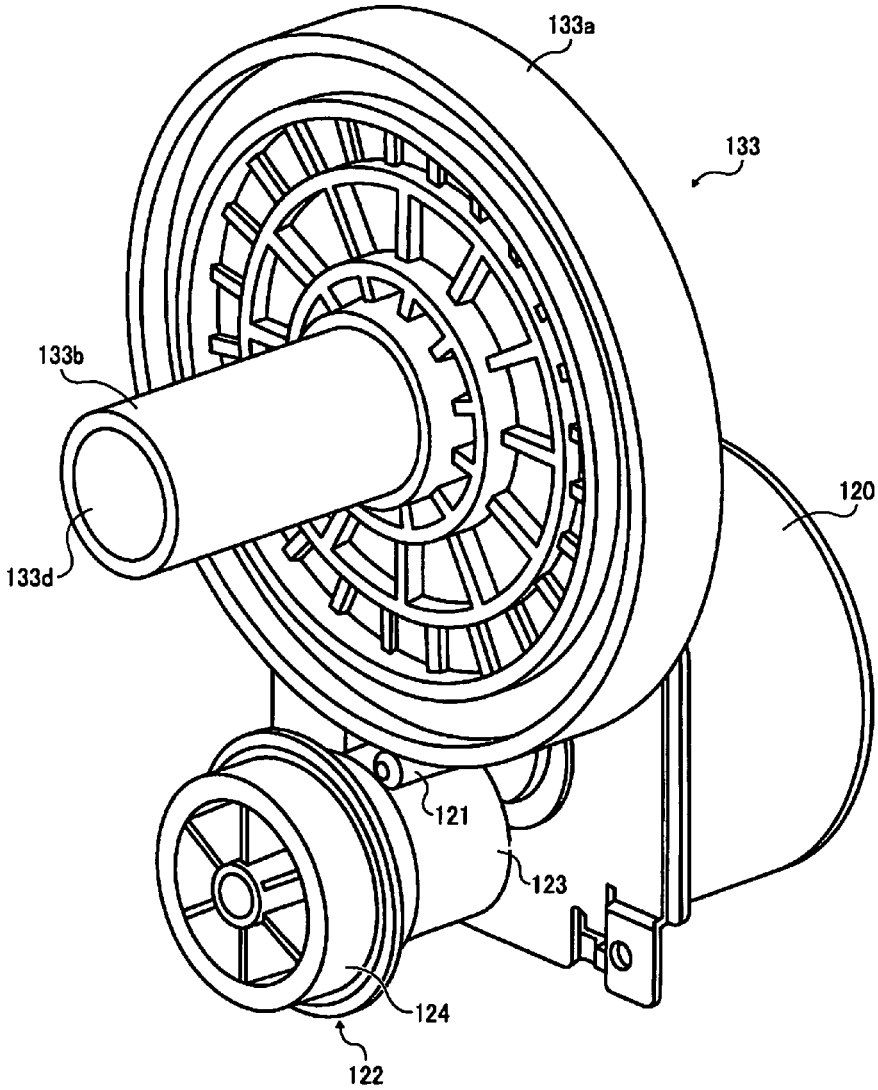
FIG. 8 is a perspective view of a relevant portion of a photosensitive-element gear for yellow.
Figure 9:
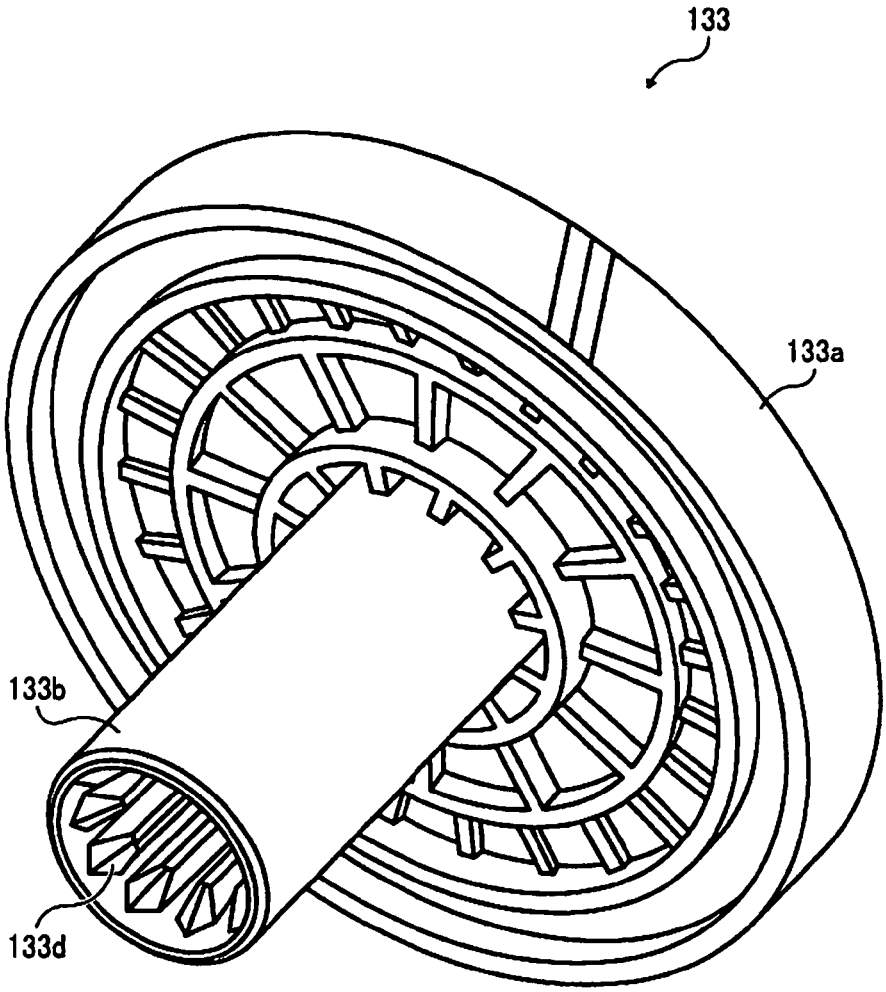
FIG. 9 is an enlarged perspective view of the photosensitive-element gear.
Figure 10:
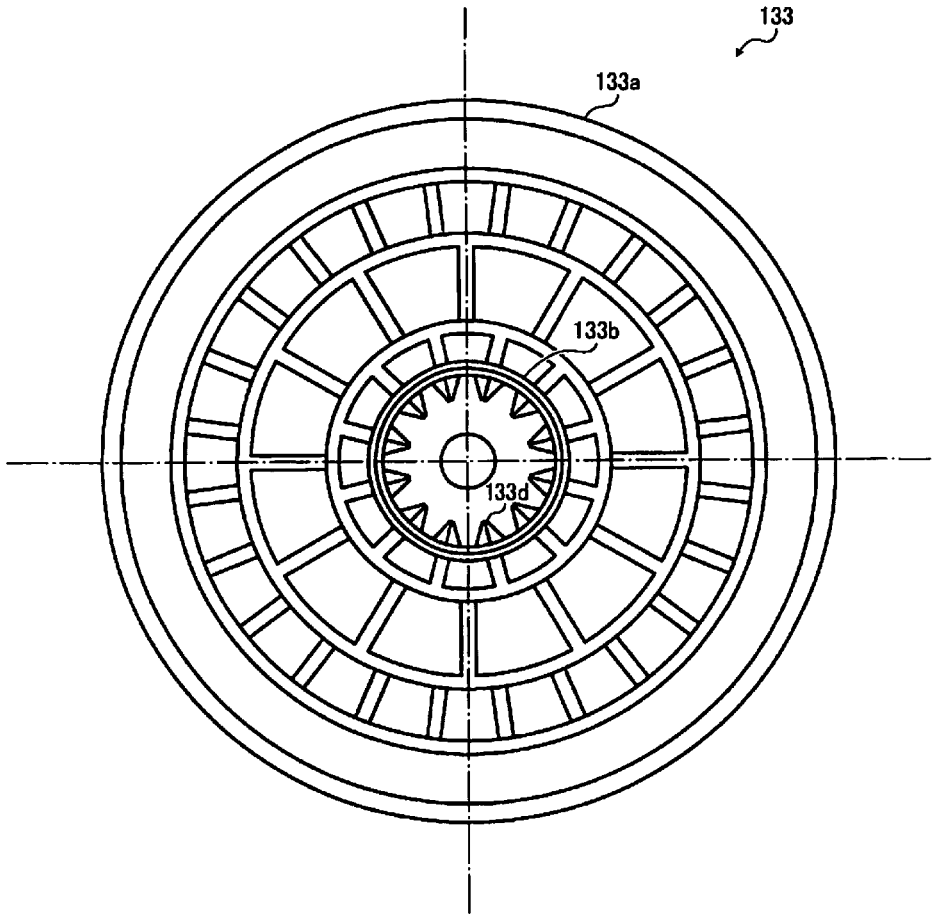
FIG. 10 is a front view of the photosensitive-element gear.
Figure 11:
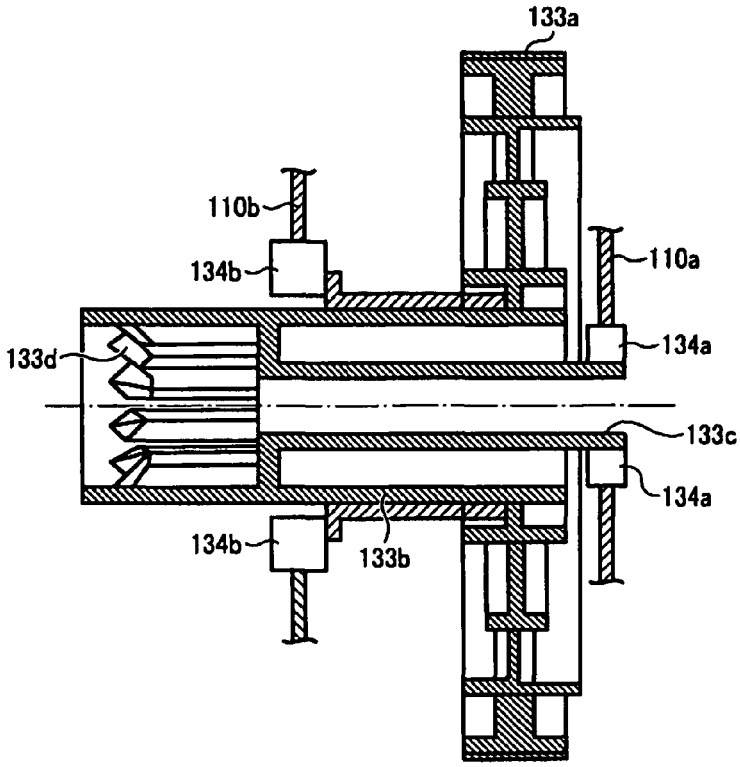
FIG. 11 is a cross-section view of a relevant portion of the photosensitive-element gear in an axis direction of the photosensitive-element gear.

FIG. 8 is a perspective view of the photosensitive-element gear 133Y and its periphery, FIG. 9 is a perspective view of the photosensitive-element gear 133Y, FIG. 10 is a front view of the photosensitive-element gear 133Y, and FIG. 11 is a cross-section view of the photosensitive-element gear 133Y and its periphery in an axis direction of the rotary shaft of the photosensitive-element gear 133Y. In the following explanation, color code of Y is omitted.

A motor gear 121 serving as a driving unit and fixed on the rotary shaft of a process driving motor 120 engages with a first gear 123 and a photosensitive-element gear 133. The photosensitive-element gear 133 includes a disk-shaped gear portion 133*a* serving as driving-force input unit, a large-diameter boss 133*b* and a small-diameter boss 133*c* that constitute a rotary shaft unit, and a spline hole 133*d* serving as a driving-force output unit, which are integrally formed from the same material, for example, resin. The diameter of the gear portion 133*a* is larger than that of a photosensitive element 3.

The large-diameter boss 133*b* and the small-diameter boss 133*c* are rotatably supported by the first side plate 110*a* and a second side plate 110*b* that constitute a main frame of the image forming apparatus through metal sleeve bearings 134*a* and 134*b*, respectively. Δt least, the rotation of the sleeve bearing 134*b* mounted on the large-diameter boss 133*b* is restricted in the rotational direction of the photosensitive-element gear 133 relative to the second side plate 110*b*. Specifically, the sleeve bearing 134*b* has a protruding portion on the outer circumferential surface that protrudes toward a radial direction of the sleeve bearing 134*b*. When mounting the sleeve bearing 134*b* on the second side plate 110*b*, the protruding portion engages with a rotation regulating hole formed in the second side plate 110*b*, so that the rotation of the sleeve bearing 134*b* is regulated relative to the second side plate 110*b*.

The spline hole 133*d* opens at an end of the large-diameter boss 133*b*, and an internal gear having a plurality of teeth is formed on an inner circumferential surface of the spline hole 133*d*. As shown in FIG. 7, one end of the rotary shaft of the photosensitive element 3 is configured with a spline shaft 135. In the state that the process unit 1 is set and positioned to the body of the image forming apparatus, the external teeth of the spline shaft 135 is meshed with the internal teeth of the spline hole 133*d*, thereby transmitting the rotary driving force of the process driving motor 120 to the photosensitive element 3 through the photosensitive-element gear 133.

In the present embodiment, the spline hole 133*d* is formed in the large-diameter boss 133*b* and the spline shaft 135 is formed on the rotary shaft of the photosensitive element 3; however, the spline shaft 135 can be formed on the large-diameter boss 133*b* and the spline hole 133*d* can be formed in the rotary shaft of the photosensitive element 3.

In the image forming apparatus, the gear portion 133*a*, the large-diameter boss 133*b*, the small-diameter boss 133*c*, and the spline hole 133*d* that constitute the photosensitive-element gear 133 are integrally formed from the same material such as resin, so that backlash is not produced, thereby allowing to reduce fluctuation in the rotational velocity of the photosensitive element 3.

However, the resin for forming the photosensitive-element gear 133 has linear expansion coefficient larger than that of the metal for forming the sleeve bearings 134*a* and 134*b*. If the photosensitive-element gear 133 thermally expands due to temperature change in the operating environment or heat from the heat source such as a motor, a fixing unit, or the like in the image forming apparatus, the gap between the outer circumferential surface of the large-diameter boss 133*b* and the inner circumferential surface of the sleeve bearing 134*b* is reduced, so that friction load between the large-diameter boss 133*b* and the sleeve bearing 134*b* increases and rotational load on the photosensitive-element gear 133 increases. This may cause overload on the process driving motor 120 to be stopped.

By the thermal expansion of the photosensitive-element gear 133, the gap between the small-diameter boss 133*c* and the sleeve bearing 134*a* is reduced slightly. However, the dimensional change of the small-diameter boss 133*c* is small compared with that of the large-diameter boss 133*b*, so that overload that may stop the process driving motor 120 does not occur on the photosensitive-element gear 133.

Experiments conducted by the inventors are explained below. The inventors addressed the adverse affect (rotational load) on the process driving motor 120 by the friction between the large-diameter boss 133*b* and the sleeve bearing 134*b*, and the small-diameter boss 133*c* and the sleeve bearing 134*a* in the experiments.

Figure 12:
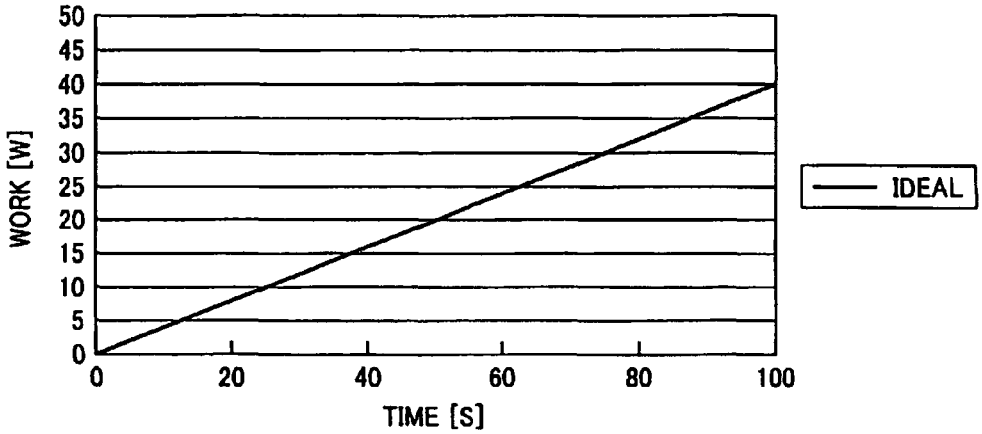
FIG. 12 is a graph of an ideal line of a relation between friction and work of motor in experiments explaining that the friction between the rotary shaft unit of the photosensitive-element gear and the sleeve bearing does not adversely affect on rotational load of a process driving motor.

Work of the process driving motor 120 (DC servomotor driven on constant voltage) obtained by multiplying a driving current of the process driving motor 120 by motor operation time is employed for verifying rotary load on the process driving motor 120. FIG. 12 is a graph of an ideal line in experiments explaining a relation between work of motor and the motor operation time. The ideal line is obtained under the conditions where there is no adverse affect on the process driving motor 120 by the friction. A slope of the ideal line in the graph, that is, work of motor divided by the motor operation time is 0.04 W/s. Any state larger than the ideal line in the graph means that the friction causes rotational overload on the process driving motor 120.

Figure 13A:
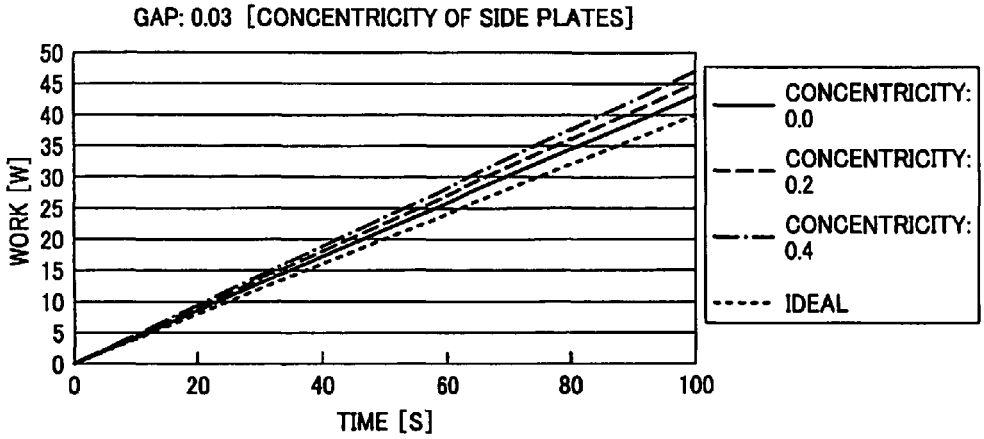
FIGS. 13A and 13B are graphs explaining experimental results of a relation between the friction and work of motor when varying concentricity of mounting holes in first and second side plates in which the sleeve bearings are mounted while keeping the ambient temperature at 25° C.
Figure 13B:
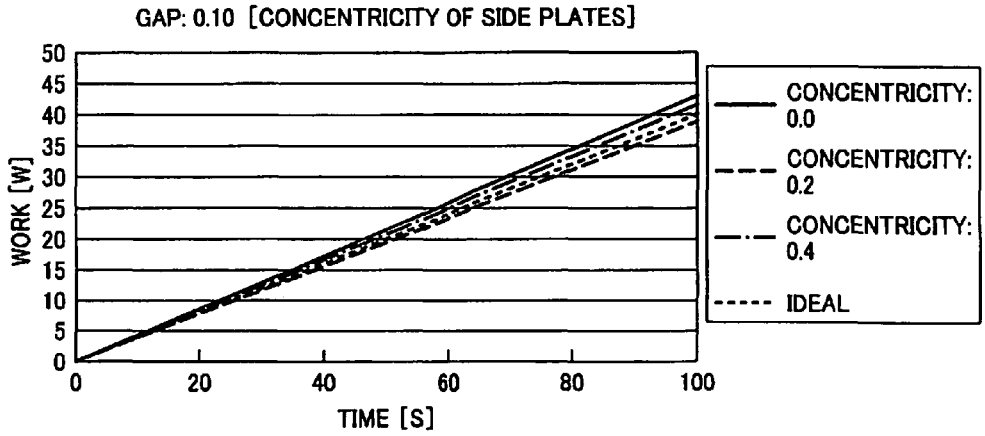

FIGS. 13A and 13B are graphs explaining results of verifying work of motor when varying concentricity between mounting holes in the first side plate 110*a* and in the second side plate 110*b* on which a corresponding one of the sleeve bearings 134*a* and 134*b* is mounted while keeping the ambient temperature at 25° C. The "concentricity" means amount of displacement between center points of the mounting holes in a state where the first side plate 110*a* and the second side plate 110*b* are opposed in parallel. Specifically, FIG. 13A explains the result of the experiment on the condition that the difference (hereinafter, "gap") Δx1 between the outer radius of the large-diameter boss 133*b* and the inner radius of the sleeve bearing 134*b* is set to 0.03 millimeter, and FIG. 13B explains the result of the experiment with the gap Δx1 being set, to 0.1 millimeter.

As shown in FIG. 13A, when the gap Δx1 is set to be as narrow as 0.03 millimeter, even if the concentricity is 0 millimeters, the slope of the line is larger than that of the ideal line, thereby causing rotational overload on the process driving motor 120. Furthermore, as the concentricity is increased to 0.2 millimeter and 0.4 millimeter, the slope of the line increases, i.e., the rotational load on the process driving motor 120 increases.

In contrast, as shown in FIG. 13B in which the gap Δx1 is set to be as relatively large as 0.1 millimeter, the slope of the line is slightly larger than that of the ideal line under the most unfavorable condition of 0.4 millimeter for the concentricity. However, when the concentricity is 0.2 millimeter and 0.4 millimeter, the slopes of the lines almost match with that of the ideal line, so that the rotational overload hardly occurs on the process driving motor 120.

The finding from the experiments is that the rotational load on the process driving motor 120 can be reduced by setting the gap Δx1 to be wider.

Figure 14A:
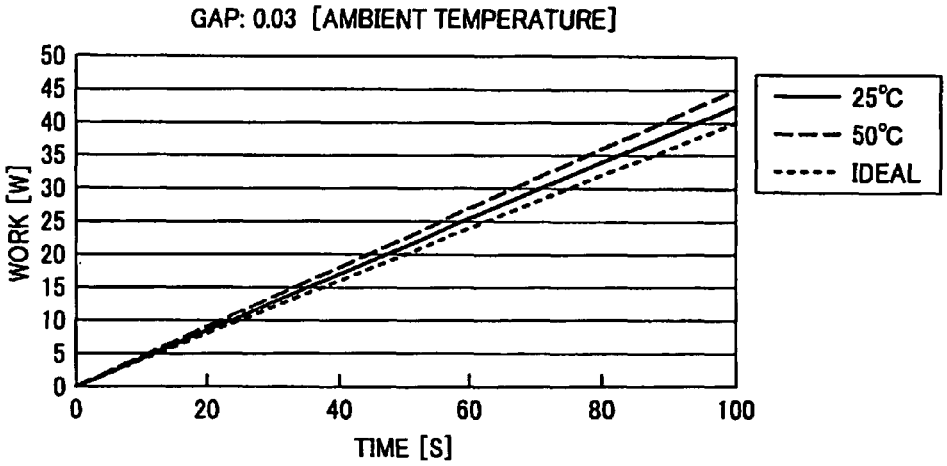
FIGS. 14A and 14B are graphs explaining results of experiments conducted under the ambient temperatures of 25° C. and 50° C. by setting concentricity to 0 millimeters.
Figure 14B:
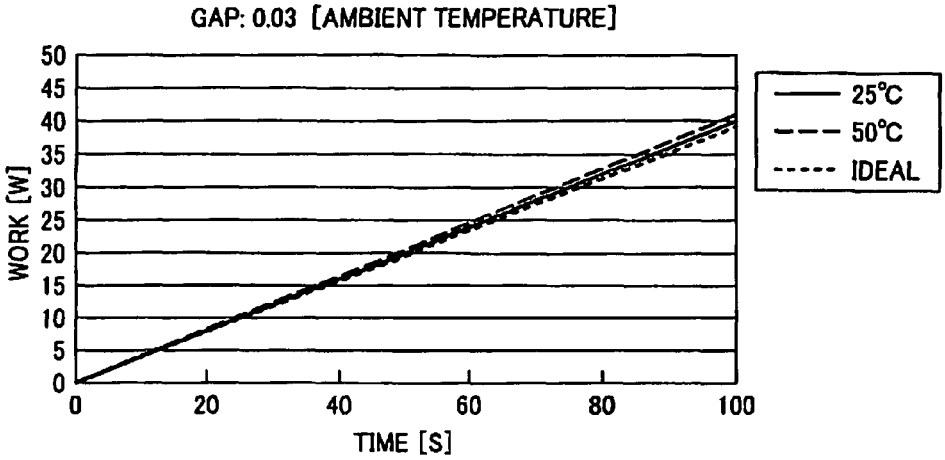

FIGS. 14A and 14B are graphs each explaining results of experiments conducted under the ambient temperatures of 25° C. and 50° C. and concentricity of 0 millimeters.

FIG. 14A explains result of the experiment performed with the gap Δx1 being set to 0.03 millimeter, and FIG. 14B explains result of the experiment with the gap Δx1 being set to 0.1 millimeter.

As shown in FIG. 14A, when the gap Δx1 is set to be as narrow as 0.03 millimeter, the slopes of the lines under the ambient temperatures of 25° C. and 50° C. are both larger than that of the ideal line, so that rotational overload is imposed on the process driving motor 120. Furthermore, as the ambient temperature rises, the slope of the line increases, i.e., the rotational load increases. When the ambient temperature rises, the photosensitive-element gear 133 thermally expands, so that the gap between the large-diameter boss 133*b* and the sleeve bearing 134*b* is narrowed to increase the sliding load between the large-diameter boss 133*b* and the sleeve bearing 134*b*. This results in increasing the rotational load on the process driving motor 120.

In contrast, as shown in FIG. 14B in which the gap Δx1 is set to be as relatively large as 0.1 millimeter, the slopes of the lines under the ambient temperatures of 25° C. and 50° C. both nearly match with that of the ideal line, so that the rotational overload hardly occurs on the process driving motor 120.

Figure 15A:
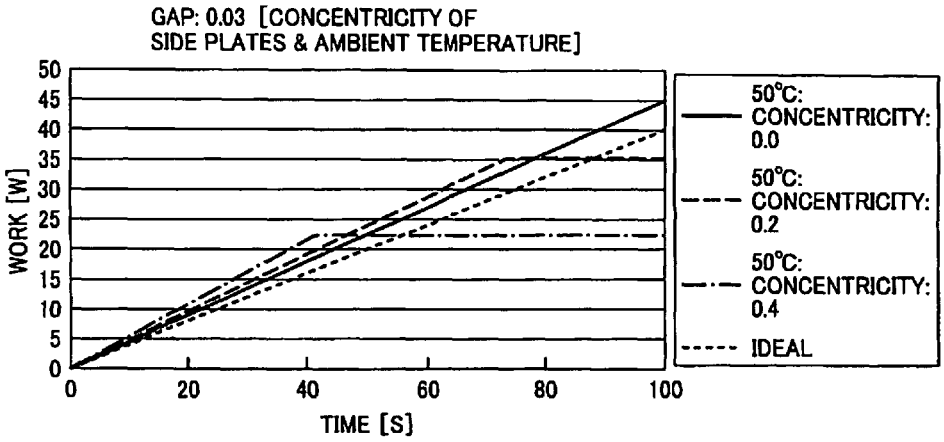
FIGS. 15A and 15B are graphs explaining results of experiments conducted by varying concentricity while keeping the ambient temperature at 50° C.
Figure 15B:
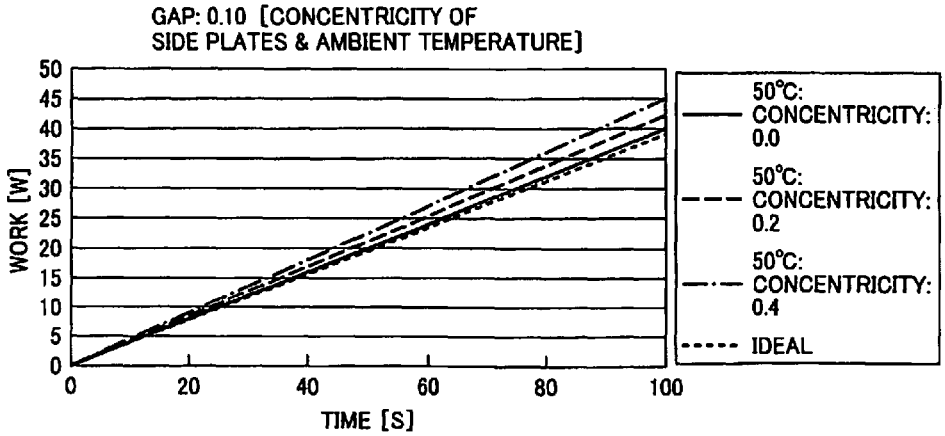

FIGS. 15A and 15B are graphs explaining results of experiments conducted by varying concentricity while keeping the ambient temperature at 50° C. The gap Δx1 is set to 0.03 millimeter in FIG. 15A and 0.1 millimeter in FIG. 15B.

As shown in FIG. 15A, when the gap Δx1 is set to be as narrow as 0.03 millimeter and the concentricity is 0.4 millimeter, the large-diameter boss 133*b* melted and adhered to the sleeve bearing 134*b* causing the process driving motor 120 to stop at the point that the motor operation time reached about 40 minutes. When the concentricity is 0.2 millimeter, the large-diameter boss 133*b* also melted and adhered to the sleeve bearing 134*b* causing the process driving motor 120 to stop at the point that the motor operation reached about 75 minutes.

In contrast, as shown in FIG. 15B in which the gap Δx1 is set to be as relatively large as 0.1 millimeter, the slope of the line nearly matches with that of the ideal line under the condition of the concentricity of 0 millimeters, so that the rotational overload hardly occurs on the process driving motor 120. Under the conditions of concentricity of 0.2 millimeter and 0.4 millimeter, the slopes of the lines are larger than that of the ideal line, so that the rotational load is imposed on the process driving motor 120; however the rotational load is not so large to stop the process driving motor 120.

The image forming apparatus is designed assuming that the maximum ambient temperature is 50° C. Thus, the gap Δx1 is set such that rotational overload does not occur on the process driving motor 120 even under the ambient temperature of 50° C.

The photosensitive-element gear 133 is formed from the material having linear expansion coefficient "b" larger than linear expansion coefficient "a" for the sleeve bearing 134*b*. Therefore, if the gap Δx1 satisfies Inequality (1) even when the ambient temperature rises to 50° C., the gap between the thermally-expanded large-diameter boss 133*b* and the sleeve bearing 134*b* can be ensured, so that rotational load as large as stopping the process driving motor 120 does not occur.

$$\Delta x1 > r1 \times \Delta t \times a - R1 \times \Delta t \times b \quad (1)$$

where r1 is the outer radius of the large-diameter boss 133*b* and R1 is the inner radius of the sleeve bearing 134*b*, relative to a reference temperature, and Δt is a maximum amount of temperature change of the driving-force transmission device relative to the reference temperature.

Even if the gap Δx1 satisfies Inequality (1); however, when the concentricity between the first side plate 110*a* and the second side plate 110*b* is unsatisfactory, the outer circumferential surface of the large-diameter boss 133*b* comes into contact with the inner circumferential surface of the sleeve bearing 134*b* causing the sliding load, which may result in applying overload on the process driving motor 120. Accordingly, when the concentricity between the first side plate 110*a* and the second side plate 110*b* is unsatisfactory, it is preferable to set the gap Δx1 while taking the concentricity into consideration.

Figure 16:
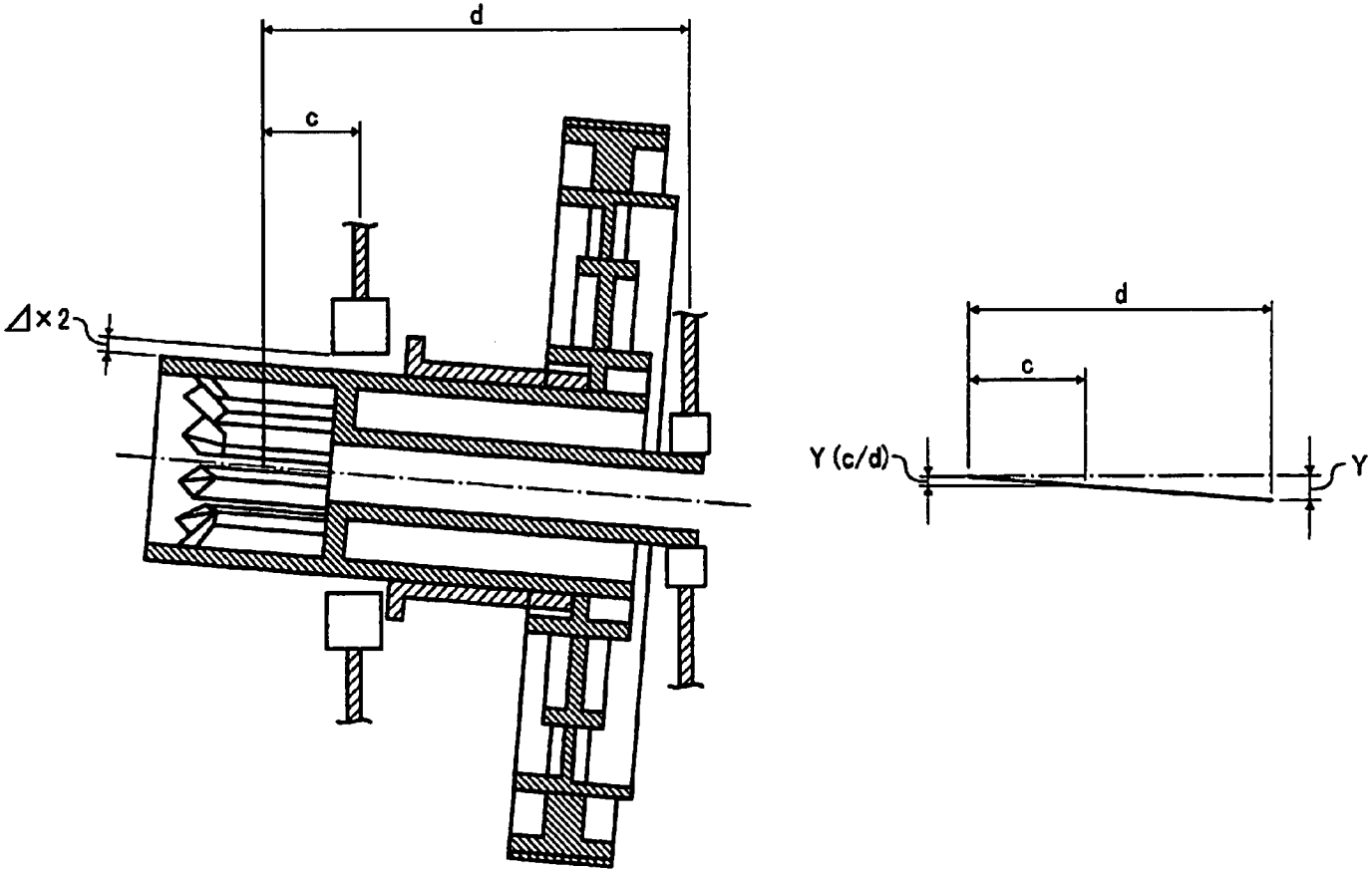
FIG. 16 is a cross-section view of a relevant portion of the photosensitive-element gear when concentricity between the first and second side plates is unsatisfactory.

FIG. 16 is a cross-section view of the photosensitive-element gear 133Y and its periphery in the axis direction of the rotary shaft of the photosensitive-element gear 133Y when concentricity between the first side plate 110*a* and the second side plate 110*b* is unsatisfactory. The amount of displacement of the concentricity between the first side plate 110*a* and the second side plate 110*b* from 0 millimeters can be substantially obtained from y×(c/d), in which "y" is an amount of the eccentricity between the first side plate 110*a* and the second side plate 110*b*, "c" is a distance from an engaging portion between the spline hole 133*d* and the spline shaft 135 to a bearing portion of the sleeve bearing 134*b* for receiving the second side plate lob, and "d" is a distance from the engaging portion between the spline hole 133*d* and the spline shaft 135 to a bearing portion of the sleeve bearing 134*a* for receiving the first side plate 110*a*. Therefore, when the concentricity needs to be considered for setting the gap Δx1, it is desirable that the gap Δx1 satisfies Inequality (2):

$$\Delta x1 > r1 \times \Delta t \times a - R1 \times \Delta t \times b + y \times (c/d) \quad (2)$$

Under a relatively low ambient temperature in the present embodiment, the gap between the large-diameter boss 133*b* and the sleeve bearing 134*b* is relatively large, so that backlash may be produced in the gap between the large-diameter boss 133*b* and the sleeve bearing 134*b*. However, the spline shaft 135 engages with the spline hole 133*d*, and the photosensitive element 3 is positioned relative to the casing of the process unit 1 that is positioned relative to the body of the image forming apparatus. Therefore, the end of the rotary shaft unit on the side of the large-diameter boss 133*b* is positioned stably without causing any backlash. The end of the rotary shaft unit on the side of the small-diameter boss 133*c* is rotatably supported by the first side plate 110*a* through the sleeve bearing 134*a* without backlash as conventionally done. According to the present embodiment, even if the ambient temperature is relatively low and the gap between the large-diameter boss 133*b* and the sleeve bearing 134*b* is relatively large, the photosensitive-element gear 133 is positioned without causing backlash. As a result, backlash-attributable fluctuation in the rotational velocity of the photosensitive element 3 does not occur.

In the image forming apparatus, the rotary driving force from the process driving motor 120 is transmitted to the photosensitive element 3 by the driving-force transmission device to rotate the photosensitive element 3 to form a toner image on the photosensitive element 3, which is transferred onto the recording sheet P thereby forming an image on the recording sheet P. The driving-force transmission device includes the photosensitive-element gear 133. The photosensitive-element gear 133 is configured by integrally forming the rotary shaft unit including the large-diameter boss 133*b* at one end and the small-diameter boss 133*c* at another end, the gear portion 133*a* that engages with the motor gear 121 coupled to the process driving motor 120 to receive the rotary driving force, and the spline hole 133*d* with which the spline shaft 135 engages to output the rotary driving force to the rotational shaft of the photosensitive element 3. The spline hole 133*d* is formed on the side of the large-diameter boss 133*b* to engage with the spline shaft 135 arranged concentrically with the photosensitive-element gear 133, and the gear portion 133*a* is formed on the outer circumference of the rotary shaft unit. The driving-force transmission device further includes the first side plate 110*a* and the second side plate 110*b* that rotatably support the rotary shaft unit at the support portions for the large-diameter boss 133*b* and the small-diameter boss 133*c*, and the sleeve bearing 134*b* that is arranged between the support portion for the large-diameter boss 133*b* and the second side plate 110*b* to regulate the rotation of the photosensitive-element gear 133 in the rotational direction relative to the second side plate 110*b*. The photosensitive-element gear 133 is formed of resin of which linear expansion coefficient is larger than that of the sleeve bearing 134*b*. Furthermore, the photosensitive-element gear 133 is configured such that the gap Δx1 between the inner radius R1 of the sleeve bearing 134*b* and the outer radius r1 of the rotary shaft unit relative to a reference temperature satisfies Inequality (1).

With such a configuration, the gap between the large-diameter boss 133*b* and the sleeve bearing 134*b* can be ensured even if the temperature of the driving-force transmission device rises to the maximum temperature (50° C. in the present embodiment) within the normally assumable range. Therefore, increase in the rotational load caused by the thermal expansion of the photosensitive-element gear 133 can be suppressed. Furthermore, even if a gap between the large-diameter boss 133*b* and the sleeve bearing 134*b* presents, the photosensitive-element gear 133 is positioned without backlash in the state that the process unit 1 is set in the image forming apparatus, suppressing backlash-attributable fluctuation in the rotational velocity of the photosensitive element 3.

Furthermore, the engaging portion between the spline hole 133*d* formed at the end of the side of the large-diameter boss 133*b* in the rotary shaft unit and the spline shaft 135 arranged concentrically with the rotary shaft unit makes spline engagement by meshing between external teeth on the spline shaft 135 and internal teeth in the spline hole 133*d*. With such a configuration, even if a gap between the large-diameter boss 133*b* and the sleeve bearing 134*b* presents, the spline hole 133*d* engages with the spline shaft 135 that is positioned, so that the photosensitive-element gear 133 can be positioned without backlash.

Moreover, the first side plate 110*a* and the second side plate 110*b* that support the photosensitive-element gear 133 are not integrally formed, so that the concentricity can be unsatisfactory. Accordingly, it is preferable that the gap Δx1 satisfy Inequality (2). With the inequality-satisfied configuration, even if the concentricity is unsatisfactory, increase in the rotational load caused by the thermal expansion of the photosensitive-element gear 133 can be stably suppressed.

Moreover, a plurality of the photosensitive elements 3Y, 3C, 3M, and 3K is arranged in the image forming apparatus such that the direction perpendicular to the rotational direction (axial direction of the photosensitive element 3) of surfaces of the photosensitive elements 3Y, 3C, 3M, and 3K conforms each other, and the Y-toner image, the C-toner image, the M-toner image, and the K-toner image formed on surfaces of the photosensitive elements 3Y, 3C, 3M, and 3K are superimposed to form a four-color image to be transferred onto the recording sheet P. In such tandem-type image forming apparatus, fluctuation in the rotational velocity of the photosensitive element 3 leads to color shift that significantly degrades image quality, so that elimination of the factors for fluctuating the rotational velocity of the photosensitive element 3 is needed. Accordingly, the driving-force transmission device can be advantageously applied to the tandem-type image forming apparatus.

In the present embodiment, the first side plate 110*a* and the second side plate 110*b* are both shared among the photosensitive-element gears 133Y, 133C, 133M, and 133K to support the photosensitive-element gears 133Y, 133C, 133M, and 133K. In this case, when setting the gap Δx1 based on Inequality (2), the maximum amount of eccentricity out of the amounts of the eccentricity of the photosensitive-element gears 133Y, 133C, 133M, and 133K is employed for the amount of the eccentricity "y", whereby the increase in the rotational load on all the photosensitive-element gears. 133Y, 133C, 133M, and 133K can be suppressed even if the gap Δx1 is identically set in all the photosensitive-element gears 133Y, 133C, 133M, and 133K to suppress manufacturing cost.

Furthermore, the photosensitive element 3 is positioned to the process unit 1 that is detachable from the body of the image forming apparatus, so that spline-engagement of the spline hole 133*d* with the spline shaft 135 of the photosensitive element 3 enables stable positioning of the photosensitive-element gear 133 without backlash.

Although the present embodiment has addressed suppressing the overload on the process driving motor 120 due to the increased rotational load on the photosensitive-element gear 133 that is caused by the narrowing of the gap between the large-diameter boss 133*b* and the sleeve bearing 134*b* due to thermal expansion of the photosensitive-element gear 133. However, even in a different configuration to be employed to the photosensitive-element gear 133, the rotational load may be increased in the similar manner, causing overload on the process driving motor 120. Specifically, in the configuration that the sleeve bearing 134*b* is integrally formed with the large-diameter boss 133*b* to regulate the rotation of the large-diameter boss 133*b* and not regulating the motion of the second side plate 110*b*, when the photosensitive-element gear 133 is formed from a material having linear expansion coefficient "b" larger than linear expansion coefficient "e" of the second side plate 110*b*, the gap between the large-diameter boss 133*b* and the second side plate 110*b* is reduced, thereby increasing the rotational load on the photosensitive-element gear 133. For such a configuration, it is preferable that the gap $\Delta x2$ between the inner radius R2 of the second side plate 110*b* and the outer radius r2 of the large-diameter boss 133*b* relative to a reference temperature satisfy Inequality (3):

$$\Delta x2 > r2 \times \Delta t \times e - R2 \times \Delta t \times b \quad (3)$$

In this case, increase in the rotational load on the photosensitive-element gear 133 due to thermal expansion of the photosensitive-element gear 133 can be suppressed within the normally assumable range.

The present invention is not limited to the tandem-type image forming apparatus, and it can be advantageously applied to an alternative type of a color image forming apparatus and a B&W image forming apparatus.

According to one aspect of the present invention, the use of the driving-force transmitting member in which the driving-force input unit, the driving-force output unit, and the rotary shaft unit are integrally formed brings superior effect of suppressing increase in the rotational load on the thermally-expanded driving-force transmitting member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A driving-force transmission device comprising:

a driving-force transmitting member that includes a rotary shaft unit including a large-diameter portion at a first end and a small-diameter portion at a second end, a driving-force input unit that is engaged with a driving unit that is connected to a driving source to receive a rotary driving force, and a driving-force output unit that is engaged with a drive target to output the rotary driving force to the drive target, which are integrally formed, one of the driving-force input unit and the driving-force output unit being formed at the first end and is engaged with an engaging target arranged concentrically on the rotary shaft unit, other one of the driving-force input unit and the driving-force output unit being formed on an outer circumference of the rotary shaft unit;

a support member that rotatably supports the rotary shaft unit at a first support portion of the large-diameter portion and at a second support portion of the small-diameter portion; and a sleeve bearing that is arranged between the first support portion and the support member such that rotation of the driving-force transmitting member in a rotational direction relative to the support member is restricted by friction between the sleeve bearing and the first support portion of the large-diameter portion, wherein the driving-force transmitting member is formed of a material having a linear expansion coefficient larger than that of the sleeve bearing, and $\Delta x1 > r1 \times \Delta t \times a - R1 \times \Delta t \times b$ is satisfied, where R1 is inner radius of the sleeve bearing, r1 is outer radius of the rotary shaft unit, $\Delta x1$ is difference between the inner radius R1 and the outer radius r1 at a reference temperature, $\Delta t$ is maximum amount of temperature change of the driving-force transmitting member relative to the reference temperature, a is linear expansion coefficient of the sleeve bearing, and b is linear expansion coefficient of the driving-force transmitting member.

2. The driving-force transmission device according to claim 1, wherein the one of the driving-force input unit and the driving-force output unit is spline engaged with the engaging target.

3. The driving-force transmission device according to claim 2, wherein the support member includes a first support member that rotatably supports the rotary shaft unit at the first support portion and a second support member that rotatably supports the rotary shaft unit at the second support portion, which are separately formed, and $\Delta x1 > r1 \times \Delta t \times a - R1 \times \Delta t \times b + yx(c/d)$ is satisfied, where y is amount of eccentricity between the first support portion and the second support portion, c is distance between an engaging portion at which the one of the driving-force input unit and the driving-force output unit is spline engaged with the engaging target and the first support portion, and d is dimension between the engaging portion and the second support portion.

4. The driving-force transmission device according to claim 1, wherein $\Delta t$ is a value obtained when a maximum temperature of the driving-force transmission device is 50° C.

5. An image forming apparatus comprising:

an image carrier on which an image is formed;

a transfer unit that transfers the image on the image carrier onto a recoding medium;

a driving unit for driving the image carrier; and a driving-force transmission device according to claim 1, wherein the driving-force transmission device transmits a rotary driving force from the driving unit to the image carrier.

6. The image forming apparatus according to claim 5, wherein the image carrier includes a plurality of image carriers that is arranged in parallel in a direction perpendicular to a direction in which a surface of each of the image carrier moves, and images formed on surfaces of the image carriers are transferred onto the recording medium in a superimposing manner.

7. The image forming apparatus according to claim 6, wherein the support member includes a first support member that rotatably supports the rotary shaft unit at the first support portion and a second support member that rotatably supports the rotary shaft unit at the second support portion, which are separately formed, $\Delta x1 > r1 \times \Delta t \times a - R1 \times \Delta t \times b + yx(c/d)$ is satisfied, where y is amount of eccentricity between the first support portion and the second support portion, c is distance between an engaging portion at which the one of the driving-force input unit and the driving-force output unit is spline engaged with the engaging target and the first support portion, and d is dimension between the engaging portion and the second support portion, the support members for the driving-force transmitting members are of a same type, and y is maximum amount of eccentricity between the first support portion and the second support portion.

8. The image forming apparatus according to claim 5, further comprising a process unit that is detachable from the image forming apparatus and in which the image carrier is positioned.

9. A driving-force transmission device comprising:

a driving-force transmitting member that includes a rotary shaft unit including a large-diameter portion at a first end and a small-diameter portion at a second end, a driving-force input unit that is engaged with a driving unit that is connected to a driving source to receive a rotary driving force, and a driving-force output unit that is engaged with a drive target to output the rotary driving force to the drive target, which are integrally formed, one of the driving-force input unit and the driving-force output unit being formed at the first end and is engaged with an engaging target arranged concentrically on the rotary shaft unit, other one of the driving-force input unit and the driving-force output unit being formed on an outer circumference of the rotary shaft unit; and a support member that rotatably supports the rotary shaft unit at a first support portion of the large-diameter portion and at a second support portion of the small-diameter portion, wherein the driving-force transmitting member is formed of a material having a linear expansion coefficient larger than that of the support member that rotatably supports the rotary shaft unit at the first support portion, and $\Delta x2 > r2 \times \Delta t \times e - R2 \times \Delta t \times b$ is satisfied, where R2 is inner radius of a portion of the support member on which the rotary shaft unit of the driving-force transmitting member is attached, r2 is outer radius of the rotary shaft unit, $\Delta x2$ is difference between the inner radius R2 and the outer radius r2 at a reference temperature, $\Delta t$ is maximum amount of temperature change of the driving-force transmitting member relative to the reference temperature, e is linear expansion coefficient of the support member that rotatably supports the rotary shaft unit at the first support portion, and b is linear expansion coefficient of the driving-force transmitting member.

10. The driving-force transmission device according to claim 9, wherein $\Delta t$ is a value obtained when a maximum temperature of the driving-force transmission device is 50° C.

11. An image forming apparatus comprising:

an image carrier on which an image is formed;

a transfer unit that transfers the image on the image carrier onto a recoding medium;

a driving unit for driving the image carrier; and a driving-force transmission device according to claim 9, wherein the driving-force transmission device transmits a rotary driving force from the driving unit to the image carrier.

12. The image forming apparatus according to claim 11, wherein the image carrier includes a plurality of image carriers that is arranged in parallel in a direction perpendicular to a direction in which a surface of each of the image carrier moves, and images formed on surfaces of the image carriers are transferred onto the recording medium in a superimposing manner.

13. The image forming apparatus according to claim 12, wherein the support member includes a first support member that rotatably supports the rotary shaft unit at the first support portion and a second support member that rotatably supports the rotary shaft unit at the second support portion, which are separately formed, $\Delta x2 > r2 \times \Delta t \times e - R2 \times \Delta t \times b + yx(c/d)$ is satisfied, where y is amount of eccentricity between the first support portion and the second support portion, c is distance between an engaging portion at which the one of the driving-force input unit and the driving-force output unit is spline engaged with the engaging target and the first support portion, and d is dimension between the engaging portion and the second support portion, the support members for the driving-force transmitting members are of a same type, and y is maximum amount of eccentricity between the first support portion and the second support portion.

14. The image forming apparatus according to claim 11, further comprising a process unit that is detachable from the image forming apparatus and in which the image carrier is positioned.

* * * * *